United States Patent [19]

Yasuda

[11] Patent Number: 4,976,277

[45] Date of Patent: Dec. 11, 1990

[54] HAIR CLIP

[76] Inventor: Masahiro Yasuda, 22-6, Dairenminami 1-chome, Higashi Osakashi, Osaka, Japan

[21] Appl. No.: 290,698

[22] Filed: Dec. 27, 1988

[30] Foreign Application Priority Data

Feb. 4, 1988 [JP] Japan ..... 63-14284[U]

[51] Int. Cl.[5] ..... A45D 8/28

[52] U.S. Cl. ..... 132/279

[58] Field of Search ..... 132/23, 275, 276, 277, 132/278, 279

[56] References Cited

U.S. PATENT DOCUMENTS 1,343,239 6/1920 Thayer ..... 132/279
2,921,589 1/1960 Blomme ..... 132/279
3,590,444 7/1971 Goodman ..... 132/279

FOREIGN PATENT DOCUMENTS 0318886 10/1902 France ..... 132/279
2224103 10/1974 France ..... 132/279

*Primary Examiner*—John Weiss
*Assistant Examiner*—Adriene B. Lepiane

[57] ABSTRACT

A hair clip includes a base plate, a spring board and a retainer, the base plate pivotally supporting the retainer at one end, wherein the spring board is placed between the base plate and the retainer such that the spring board is stopped from extending lengthwise at both ends, whereby, when the retainer is latched to the free end of the base plate, the spring board is compressed lengthwise thereby to bend toward the base plate while holding the user's hairs against it.

4 Claims, 3 Drawing Sheets

HAIR CLIP

BACKGROUND AND SUMMARY OF THE INVENTION

The present invention relates to a hair clip and more particularly to an ornamental hair clip for clasping hairs by and between two metal sheets by a spring force.

There are many kinds of hair clips known in the art, which, in common with them, include a base plate fixed to an ornamental cover, a downwardly curved spring board whose both ends are fixed to the base plate, and a retainer whose one end is pivotally connected to the base plate with the other end being releasably fixed to the base plate. For example Japanese Utility Model Publication (unexamined) Nos. 45-3321, 50-47698, 50-154195 and 57-55403 disclose hair clips of this kind.

The known clips hold hairs by and between the spring board and the retainer, and when the hairs are to be released from the clip, the end of the retainer is made free from the base plate by hand.

Because of the fact that the hairs are retained between the downwardly curved spring board and the retainer, a gap is unavoidably present between the base plate and the spring board. Owing to the presence of the gap, the clip as a whole appears as if it floats on the hair, and the gap spoils the appearance of the hair. To hide the gap from sight, it is necessary to use a relatively large ornamental cover. Nevertheless, the gap often appears into sight.

The present invention is directed toward a hair clip which solves the problem pointed out with respect to the known hair clips. Thus an object of the present invention is to provide a hair clip capable of clasping hairs against the base plate, thereby producing no gap between the base plate and the spring board.

The objects of the present invention are achieved by providing a hair clip comprising a base plate, a spring board and a retainer, the base plate pivotally supporting the retainer at one end with the spring board interposed therebetween such that the spring board is stopped from extending lengthwise at both ends, whereby, when the retainer is latched to the other free end of the base plate, the spring board is compressed lengthwise thereby to bend toward the base plate with retaining hairs against it.

Other objects and advantages of the present invention will become more apparent from the following detailed description, when taken in conjunction with the accompanying drawings which show, for the purpose of illustration only, one embodiment in accordance with the present invention.

DETAILED DESCRIPTION OF THE INVENTION

Figure 1:
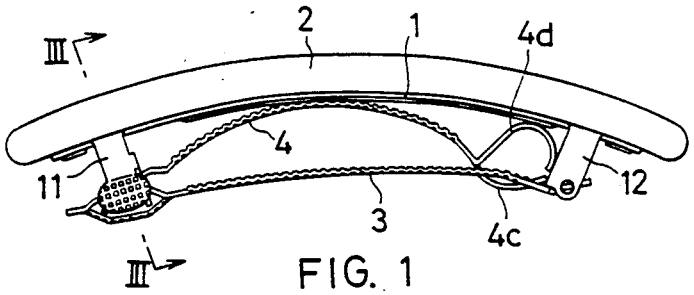
FIG. 1 is a side view showing an assembly of an ornamental cover and a hair clip according to the present invention.
Figure 2:
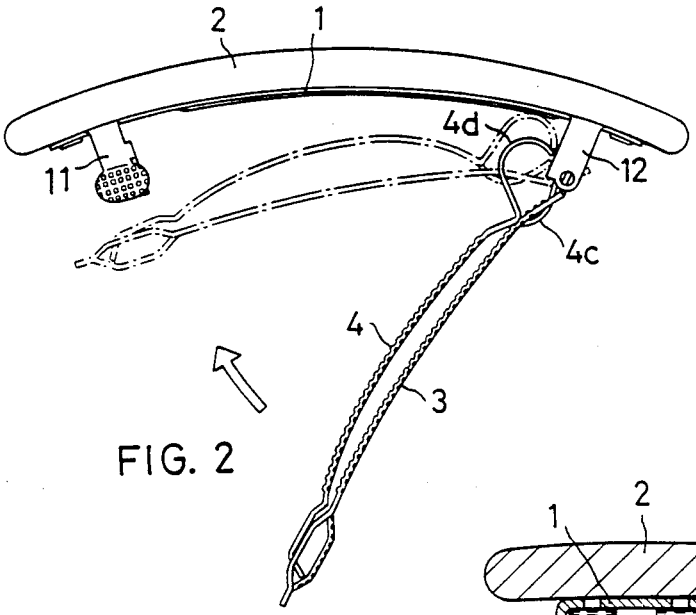
FIG. 2 is a side view of the assembly of FIG. 1 where the hair is released from the clip.
Figure 3:
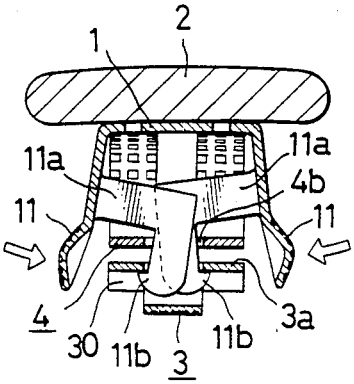
FIG. 3 is a cross sectional view taken along the line III—III in FIG. 1.
Figure 4:
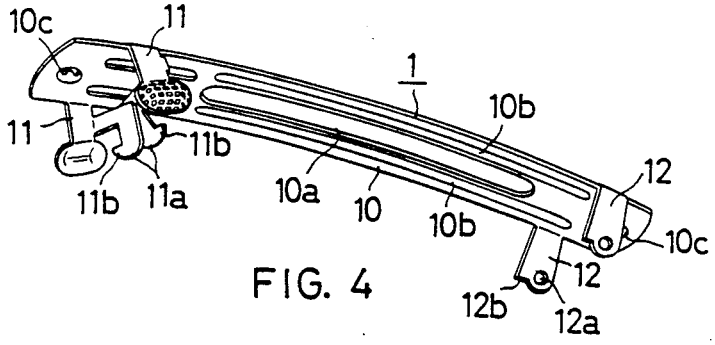
FIG. 4 is a perspective view, viewed from below, showing the base plate shown in FIG. 1.
Figure 6:
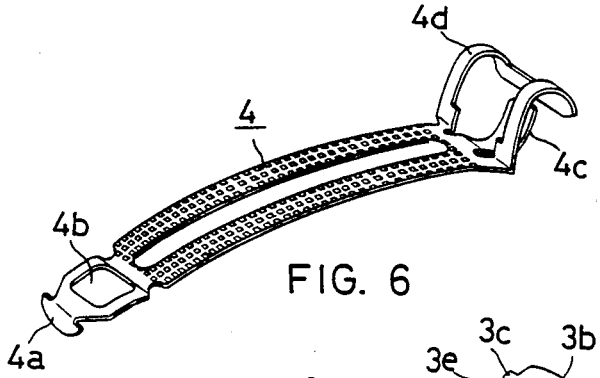
FIG. 6 is a perspective view showing the spring board shown in FIG. 1.
Figure 5:
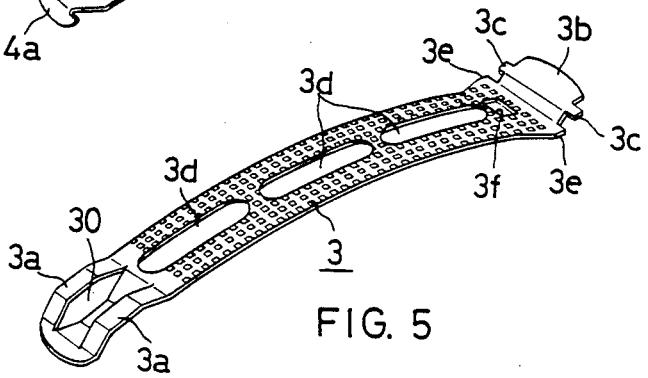
FIG. 5 is a perspective view showing the retainer shown in FIG. 1.

Referring to FIG. 1 to 7, the hair clip of the present invention comprises a base plate 1, a retainer 3 and a spring board 4. The base plate 1, made of a spring steel or the like, is curved upward, and includes a sheet portion 10, a pair of ledges 11 at one end and brackets 12 at the other end. The ledges 11 project in the same direction, and are provided with L-shaped arms 11*a* having round ends 11*b*, which partly overlap as shown in FIG. 3. The brackets 12 are provided with apertures 12*a* at their terminating ends, which have shoulders 12*b* as shown in FIG. 4. The sheet portion 10 is provided with ridges 10*b* having a slot 10*a* in the center therebetween. The base plate 1 is detachably fixed to an ornamental cover 2 of plastics.

The retainer 3 is also made of spring steel and provided with three slots 3*d* spaced from each other. In addition, the retainer 3 is provided with an engaging part 30 at one end and a journal part 3*b* at the other end. The engaging part 30 includes two arched bridges 3*a* with a dented part interposed therebetween, and the journal part 3*b* includes pivot portions 3*c*, a crosswise slot 3*f* and shoulders 3*e*. The retainer 3 is made of an anti-frictional rugged surface on either side between the engaging part 30 and the journal part 3*b*.

The slightly arched spring board 4, made of spring steel, is provided with saddle-shaped abutments 4*d* having a pawl 4*c* at one end and a rectangular opening 4*b* and a tongue 4*a* at the other end. The spring board 4 is also provided with a rugged surface on either side of the portion between the abutments 4*d* and the pawl 4*c*.

Figure 7:
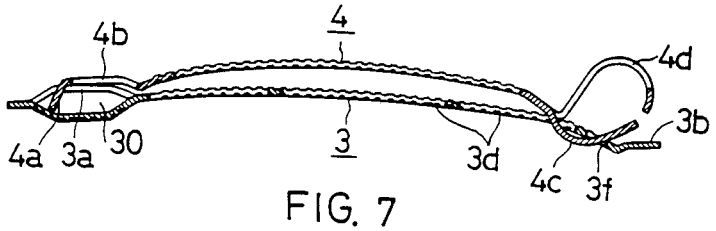
FIG. 7 is a side view showing an assembly of the retainer and the spring board.

Referring to FIG. 7, the manner of assembling the base plate 1, the retainer 3 and the spring board 4 will be described:

The tongue 4*a* of the spring board 4 is forced in between the arched bridges 3*a* of the retainer 3 and secured thereto. The tongue 4*c* is inserted through the slot 3*d* nearest the crosswise slot 3*d* from above, and then inserted through the crosswise slot 3*f* from below, thereby ensuring that the spring board 4 is slidably fixed to the retainer 3. In this way the retainer 3 and the spring board 4 are assembled into a unity as shown in FIG. 7. Then the unity is pivotally fixed to the base plate 1 by engaging the pivot portions 3*c* of the retainer 3 with the apertures 12*a* of the brackets 12 of the base plate 1. Finally the assembly is fixed to the ornamental cover 2 as shown in FIG. 1. As shown in FIG. 2, the retainer 3 and the spring board 4 are rotative as a unit with respect to the base plate 1. The abutments 4*d* of the spring board 4 abut against the rims of the brackets 12, whereas the other end thereof is fixed to the retainer 3. As a result, when the retainer 3 is rotated about the pivot portions 3*c* in the direction of arrow in FIG. 2, the spring board 4 is gradually compressed by the brackets 12 and the undersurface of the base plate 1 through the abutments 4*d* thereof. In this way the spring board 4 first slides on the retainer 3, and is gradually bent toward the base plate 1 so that the top surface of the spring board 4 comes into contact with the base plate 1, with holding the user's hairs (not shown), therebetween. In the state shown in FIG. 1 both of the shoulders 12*b* and 3*e* of the brackets 12 and the journal part 3*b* are engaged with each other, thereby stopping the retainer 3 from coming too close to the base plate 1.

When the retainer 3 is rotated in the direction of arrow in FIG. 2, the L-shaped arms 11*a* are moved toward each other and allowed to pass through the rectangular opening 4*b* of the spring board 4, thereby enabling the round ends 11*b* to anchor in between the arched bridges 3*a* of the retainer 3. In this way the retainer 3 is latched to the base plate 1, with hairs retained between the spring board 4 and the base plate 1. When the hairs are to be released from the clip, the ledges 11 are pressed toward each other by fingers, so that the L-shaped arms 11*a* overlap excessively to come through the arched bridges 3*a* of the retainer 3 and the rectangular opening 4*b* of the spring board 4. Then the retainer 3 automatically opens under the repulsion of the spring board 4.

Figure 8:
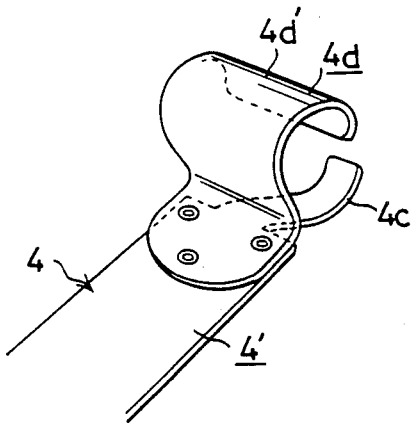
FIG. 8 is a perspective view showing a part of a modified version.

In the embodiment described above the spring board 4 is fabricated in one piece, but as shown in FIG. 8, abutments 4*d*′ can be separately made and attached to the spring board 4′ by screws or welding.

What is claimed is:

1. A hair clip comprising;

a base plate including a main body portion and a pair of brackets provided at a first end;

a retainer including first and second ends, the first end being pivotally secured to the brackets of the base plate at the first end of the base plate; and a spring board disposed between the base plate and the retainer, said spring board including first and second ends, the first end being slidably mounted to the first end of the retainer, the second end being secured to the second end of the retainer, said spring board including a pair of abutments at the first end for engaging the base plate to flex the spring board outwardly of the retainer as the second ends of the retainer and spring board move toward the base plate.

2. A hair clip as set forth in claim 1, wherein the spring board includes a pawl and the retainer includes a lengthwise slot and a crosswise slot, the pawl being passed through the lengthwise slot and engaged in the crosswise slot such that the pawl is movable in the lengthwise slot, thereby enabling the spring board to slide on the retainer.

3. A hair clip as set forth in claim 1 or 2, wherein the retainer includes a pair of arched bridges with a dented part therebetween, the arched bridges being engageable with the second end of the spring board.

4. A hair clip as set forth in claim 1 or 2, wherein the abutments of the spring board engage the the body portion and the brackets of the base plate, thereby enabling an increased compressive force to act upon the spring board.

* * * * *